US007110953B1

(12) United States Patent
Edler et al.

(10) Patent No.: US 7,110,953 B1
(45) Date of Patent: Sep. 19, 2006

(54) PERCEPTUAL CODING OF AUDIO SIGNALS USING SEPARATED IRRELEVANCY REDUCTION AND REDUNDANCY REDUCTION

(75) Inventors: Bernd Andreas Edler, Niedersachsen (DE); Gerald Dietrich Schuller, Chatham, NJ (US)

(73) Assignee: Agere Systems Inc., Allentown, PA (US)

( * ) Notice: Subject to any disclaimer, the term of this patent is extended or adjusted under 35 U.S.C. 154(b) by 921 days.

(21) Appl. No.: 09/586,072

(22) Filed: Jun. 2, 2000

(51) Int. Cl.
*G10L 19/00* (2006.01)

(52) U.S. Cl. ..... 704/500.1; 707/500; 707/200.1

(58) Field of Classification Search ..... 704/200.1, 704/200, 230, 227, 500–504, 500.1; 381/2; 375/216
See application file for complete search history.

(56) References Cited

U.S. PATENT DOCUMENTS

| | | | | |
|---|---|---|---|---|
| 5,481,614 | A * | 1/1996 | Johnston | 381/2 |
| 5,535,300 | A * | 7/1996 | Hall et al. | 704/227 |
| 5,627,938 | A * | 5/1997 | Johnston | 704/200.1 |
| 5,687,191 | A * | 11/1997 | Lee et al. | 375/216 |
| 5,699,484 | A * | 12/1997 | Davis | 704/200.1 |
| 5,774,844 | A * | 6/1998 | Akagiri | 704/230 |
| 5,950,156 | A * | 9/1999 | Ueno et al. | 704/200.1 |
| 5,956,674 | A * | 9/1999 | Smyth et al. | 704/200.1 |
| 2001/0047256 | A1* | 11/2001 | Tsurushima et al. | 704/200 |

OTHER PUBLICATIONS

Srinivasan et al. high-quality audio compression using an adaptive wavelet packet decomposition and psychoacoustic model IEEE Transaction on signal processing, vol. 46, Apr. 1998, pp. 1085-1093.*

Smith, "the scientist and engineer's guide to digital signal processing", ISBN 0-9660176-33, 1997,p. 297-310.*

Chang et al., "A Masking-Threshold-Adapted Weighting Filter for Excitation Search," IEEE Transactions on Speech and Audio Processing, vol. 4, No. 2, 124-132 (Mar. 1996).

Soong et al., "Line Spectrum Pair (LSP) and Speech Data Compression," in Proc. IEEE International Conference on Acoustics, Speech, Signal Processing, pp. 1.10.1-1.10.4 (Mar. 1984).

Lefebvre et al., "Spectral Amplitude Warping (SAW) for Noise Spectrum Shaping in Audio Coding," IEEE International Conference on Acoustics, Speech, and Signal Processing, Germany, 335-338 (Apr. 1997).

(Continued)

*Primary Examiner*—Richemond Dorvil
*Assistant Examiner*—Qi Han

(57) ABSTRACT

A perceptual audio coder is disclosed for encoding audio signals, such as speech or music, with different spectral and temporal resolutions for redundancy reduction and irrelevancy reduction. The disclosed perceptual audio coder separates the psychoacoustic model (irrelevancy reduction) from the redundancy reduction, to the extent possible. The audio signal is initially spectrally shaped using a prefilter controlled by a psychoacoustic model. The prefilter output samples are thereafter quantized and coded to minimize the mean square error (MSE) across the spectrum. The disclosed perceptual audio coder can use fixed quantizer step-sizes, since spectral shaping is performed by the pre-filter prior to quantization and coding. The disclosed pre-filter and post-filter support the appropriate frequency dependent temporal and spectral resolution for irrelevancy reduction. A filter structure based on a frequency-warping technique is used that allows filter design based on a non-linear frequency scale. The characteristics of the pre-filter may be adapted to the masked thresholds (as generated by the psychoacoustic model), using techniques known from speech coding, where linear-predictive coefficient (LPC) filter parameters are used to model the spectral envelope of the speech signal. Likewise, the filter coefficients may be efficiently transmitted to the decoder for use by the post-filter using well-established techniques from speech coding, such as an LSP (line spectral pairs) representation, temporal interpolation, or vector quantization.

33 Claims, 5 Drawing Sheets

OTHER PUBLICATIONS

Edler et al., "Audio Coding Using a Psychoacousti Pre- And Post-Filter," Proc. IEEE Int. Conf. Acoustics, Speech and Signal Processing, vol. II, 6-9, pp. 881-884 (Jun. 2000).

Sinha et al., "The Perceptual Audio Coder (PAC)," The Digital Signal Processing Handbook; Madisetti V.K., Douglas, B.W. (Eds); CRC Press, IEEE Press, pp. 42-1-42-18 (1998).

* cited by examiner

500

600

650

PERCEPTUAL CODING OF AUDIO SIGNALS USING SEPARATED IRRELEVANCY REDUCTION AND REDUNDANCY REDUCTION

CROSS-REFERENCE TO RELATED APPLICATIONS

The present invention is related to U.S. Pat. No. 6,778,953 B1 entitled "Method and Apparatus for Representing Masked Thresholds in a Perceptual Audio Coder," U.S. Pat. No. 6,678,647 B1 entitled "Perceptual Coding of Audio Signals Using Cascaded Filterbanks for Performing Irrelevancy Reduction and Redundancy Reduction With Different Spectral/Temporal Resolution," U.S. Pat. No. 6,718,300 entitled "Method and Apparatus for Reducing Aliasing in Cascaded Filter Banks," and U.S. Pat. No. 6,647,365 entitled "Method and Apparatus for Detecting Noise-Like Signal Components," filed contemporaneously herewith, assigned to the assignee of the present invention and incorporated by reference herein.

FIELD OF THE INVENTION

The present invention relates generally to audio coding techniques, and more particularly, to perceptually-based coding of audio signals, such as speech and music signals.

BACKGROUND OF THE INVENTION

Perceptual audio coders (PAC) attempt to minimize the bit rate requirements for the storage or transmission (or both) of digital audio data by the application of sophisticated hearing models and signal processing techniques. Perceptual audio coders (PAC) are described, for example, in D. Sinha et al., "The Perceptual Audio Coder," Digital Audio, Section 42, 42-1 to 42-18, (CRC Press, 1998), incorporated by reference herein. In the absence of channel errors, a PAC is able to achieve near stereo compact disk (CD) audio quality at a rate of approximately 128 kbps. At a lower rate of 96 kbps, the resulting quality is still fairly close to that of CD audio for many important types of audio material.

Perceptual audio coders reduce the amount of information needed to represent an audio signal by exploiting human perception and minimizing the perceived distortion for a given bit rate. Perceptual audio coders first apply a time-frequency transform, which provides a compact representation, followed by quantization of the spectral coefficients. FIG. 1 is a schematic block diagram of a conventional perceptual audio coder 100. As shown in FIG. 1, a typical perceptual audio coder 100 includes an analysis filterbank 110, a perceptual model 120, a quantization and coding block 130 and a bitstream encoder/multiplexer 140.

The analysis filterbank 110 converts the input samples into a sub-sampled spectral representation. The perceptual model 120 estimates the masked threshold of the signal. For each spectral coefficient, the masked threshold gives the maximum coding error that can be introduced into the audio signal while still maintaining perceptually transparent signal quality. The quantization and coding block 130 quantizes and codes the prefilter output samples according to the precision corresponding to the masked threshold estimate. Thus, the quantization noise is hidden by the respective transmitted signal. Finally, the coded prefilter output samples and additional side information are packed into a bitstream and transmitted to the decoder by the bitstream encoder/multiplexer 140.

FIG. 2 is a schematic block diagram of a conventional perceptual audio decoder 200. As shown in FIG. 2, the perceptual audio decoder 200 includes a bitstream decoder/demultiplexer 210, a decoding and inverse quantization block 220 and a synthesis filterbank 230. The bitstream decoder/demultiplexer 210 parses and decodes the bitstream yielding the coded prefilter output samples and the side information. The decoding and inverse quantization block 220 performs the decoding and inverse quantization of the quantized prefilter output samples. The synthesis filterbank 230 transforms the prefilter output samples back into the time-domain.

Generally, the amount of information needed to represent an audio signal is reduced using two well-known techniques, namely, irrelevancy reduction and redundancy removal. Irrelevancy reduction techniques attempt to remove those portions of the audio signal that would be, when decoded, perceptually irrelevant to a listener. This general concept is described, for example, in U.S. Pat. No. 5,341,457, entitled "Perceptual Coding of Audio Signals," by J. L. Hall and J. D. Johnston, issued on Aug. 23, 1994, incorporated by reference herein.

Currently, most audio transform coding schemes implemented by the analysis filterbank 110 to convert the input samples into a sub-sampled spectral representation employ a single spectral decomposition for both irrelevancy reduction and redundancy reduction. The redundancy reduction is obtained by dynamically controlling the quantizers in the quantization and coding block 130 for the individual spectral components according to perceptual criteria contained in the psychoacoustic model 120. This results in a temporally and spectrally shaped quantization error after the inverse transform at the receiver 200. As shown in FIGS. 1 and 2, the psychoacoustic model 120 controls the quantizers 130 for the spectral components and the corresponding dequantizer 220 in the decoder 200. Thus, the dynamic quantizer control information needs to be transmitted by the perceptual audio coder 100 as part of the side information, in addition to the quantized spectral components.

The redundancy reduction is based on the decorrelating property of the transform. For audio signals with high temporal correlations, this property leads to a concentration of the signal energy in a relatively low number of spectral components, thereby reducing the amount of information to be transmitted. By applying appropriate coding techniques, such as adaptive Huffman coding, this leads to a very efficient signal representation.

One problem encountered in audio transform coding schemes is the selection of the optimum transform length. The optimum transform length is directly related to the frequency resolution. For relatively stationary signals, a long transform with a high frequency resolution is desirable, thereby allowing for accurate shaping of the quantization error spectrum and providing a high redundancy reduction. For transients in the audio signal, however, a shorter transform has advantages due to its higher temporal resolution. This is mainly necessary to avoid temporal spreading of quantization errors that may lead to echoes in the decoded signal.

As shown in FIG. 1, however, conventional perceptual audio coders 100 typically use a single spectral decomposition for both irrelevancy reduction and redundancy reduction. Thus, the spectral/temporal resolution for the redundancy reduction and irrelevancy reduction must be the same. While high spectral resolution yields a high degree of redundancy reduction, the resulting long transform window size causes reverbation artifacts, impairing the irrelevancy reduction. A need therefore exists for methods and apparatus for encoding audio signals that permit independent selection of spectral and temporal resolutions for the redundancy reduction and irrelevancy reduction. A further need exists for methods and apparatus for encoding speech as well as music signals using a psychoacoustic model (a noise-shaping filter) and a transform.

SUMMARY OF THE INVENTION

Generally, a perceptual audio coder is disclosed for encoding audio signals, such as speech or music, with different spectral and temporal resolutions for the redundancy reduction and irrelevancy reduction. The disclosed perceptual audio coder separates the psychoacoustic model (irrelevancy reduction) from the redundancy reduction, to the extent possible. The audio signal is initially spectrally shaped using a prefilter controlled by a psychoacoustic model. The prefilter output samples are thereafter quantized and coded to minimize the mean square error (MSE) across the spectrum.

According to one aspect of the invention, the disclosed perceptual audio coder uses fixed quantizer step-sizes, since spectral shaping is performed by the pre-filter prior to quantization and coding. Thus, additional quantizer control information does not need to be transmitted to the decoder, thereby conserving transmitted bits.

The disclosed pre-filter and corresponding post-filter in the perceptual audio decoder support the appropriate frequency dependent temporal and spectral resolution for irrelevancy reduction. A filter structure based on a frequency-warping technique is used that allows filter design based on a non-linear frequency scale.

The characteristics of the pre-filter may be adapted to the masked thresholds (as generated by the psychoacoustic model), using techniques known from speech coding, where linear-predictive coefficient (LPC) filter parameters are used to model the spectral envelope of the speech signal. Likewise, the filter coefficients may be efficiently transmitted to the decoder for use by the post-filter using well-established techniques from speech coding, such as an LSP (line spectral pairs) representation, temporal interpolation, or vector quantization.

A more complete understanding of the present invention, as well as further features and advantages of the present invention, will be obtained by reference to the following detailed description and drawings.

DETAILED DESCRIPTION

Figure 3:
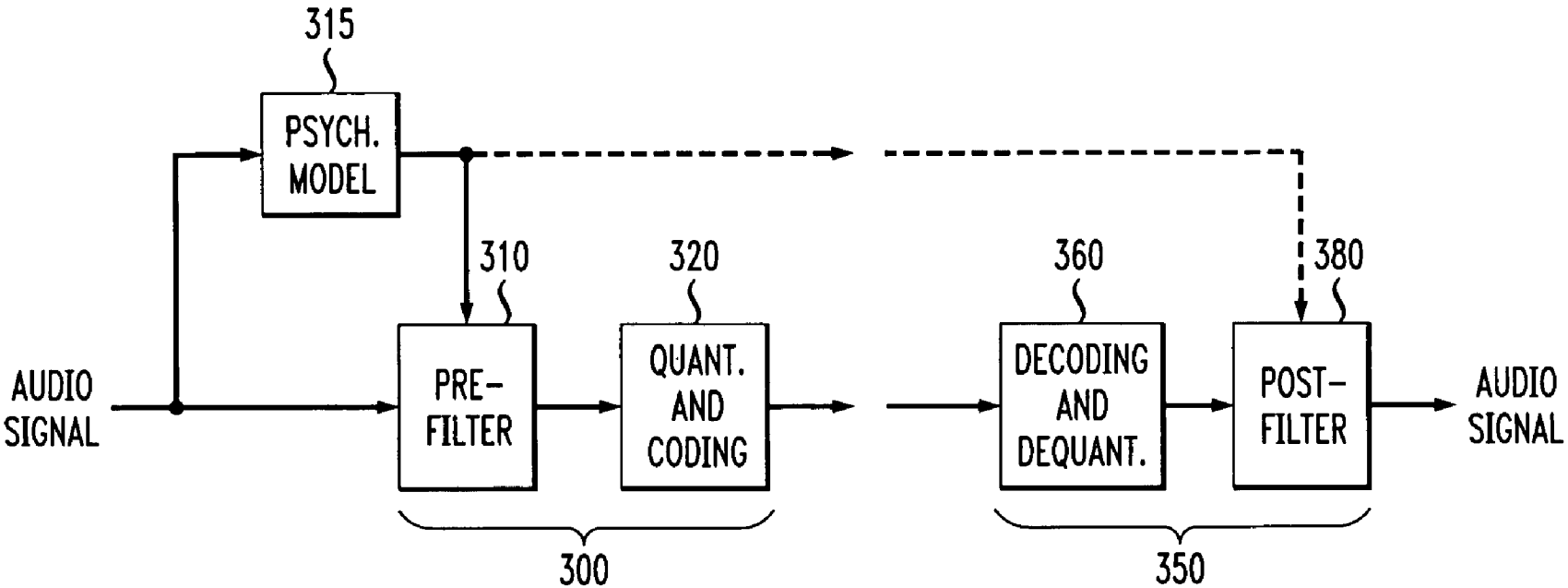
FIG. 3 is a schematic block diagram of a perceptual audio coder according to the present invention and its corresponding perceptual audio decoder.

FIG. 3 is a schematic block diagram of a perceptual audio coder 300 according to the present invention and its corresponding perceptual audio decoder 350, for communicating an audio signal, such as speech or music. While the present invention is illustrated using audio signals, it is noted that the present invention can be applied to the coding of other signals, such as the temporal, spectral, and spatial sensitivity of the human visual system, as would be apparent to a person of ordinary skill in the art, based on the disclosure herein.

According to one feature of the present invention, the perceptual audio coder 300 separates the psychoacoustic model (irrelevancy reduction) from the redundancy reduction, to the extent possible. Thus, the perceptual audio coder 300 initially performs a spectral shaping of the audio signal using a prefilter 310 controlled by a psychoacoustic model 315. For a detailed discussion of suitable psychoacoustic models, see, for example, D. Sinha et al., "The Perceptual Audio Coder," Digital Audio, Section 42, 42-1 to 42-18, (CRC Press, 1998), incorporated by reference above. Likewise, in the perceptual audio decoder 350, a post-filter 380 controlled by the psychoacoustic model 315 inverts the effect of the pre-filter 310. As shown in FIG. 3, the filter control information needs to be transmitted in the side information, in addition to the quantized samples.

Quantizer/Coder

The prefilter output samples are quantized and coded at stage 320. As discussed further below, the redundancy reduction performed by the quantizer/coder 320 minimizes the mean square error (MSE) across the spectrum.

Since the pre-filter 310 performs spectral shaping prior to quantization and coding, the quantizer/coder 320 can employ fixed quantizer step-sizes. Thus, additional quantizer control information, such as individual scale factors for different regions of the spectrum, does need not need to be transmitted to the perceptual audio decoder 350.

Figure 1:
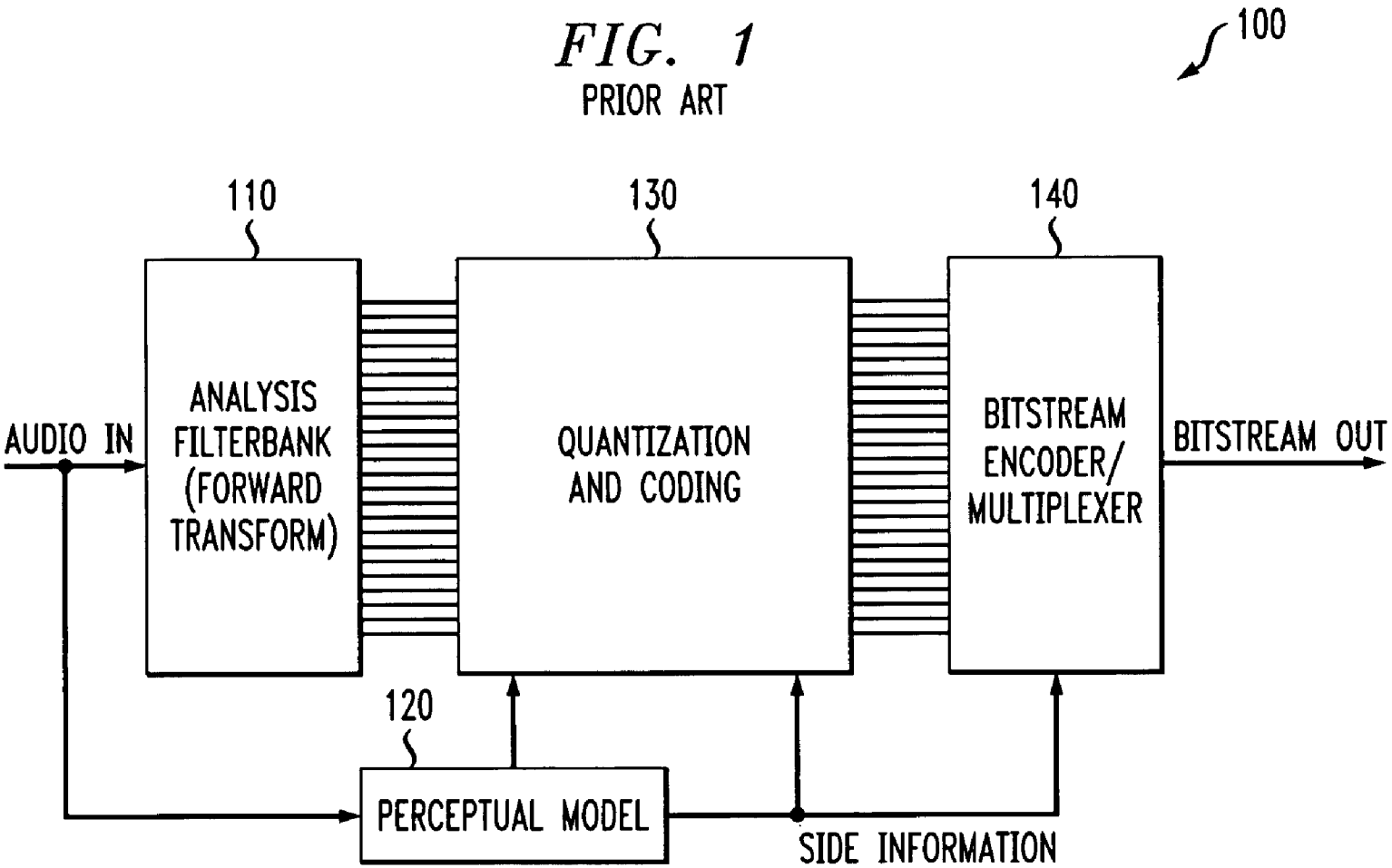
FIG. 1 PRIOR ART
FIG. 1 is a schematic block diagram of a conventional perceptual audio coder.
Figure 2:
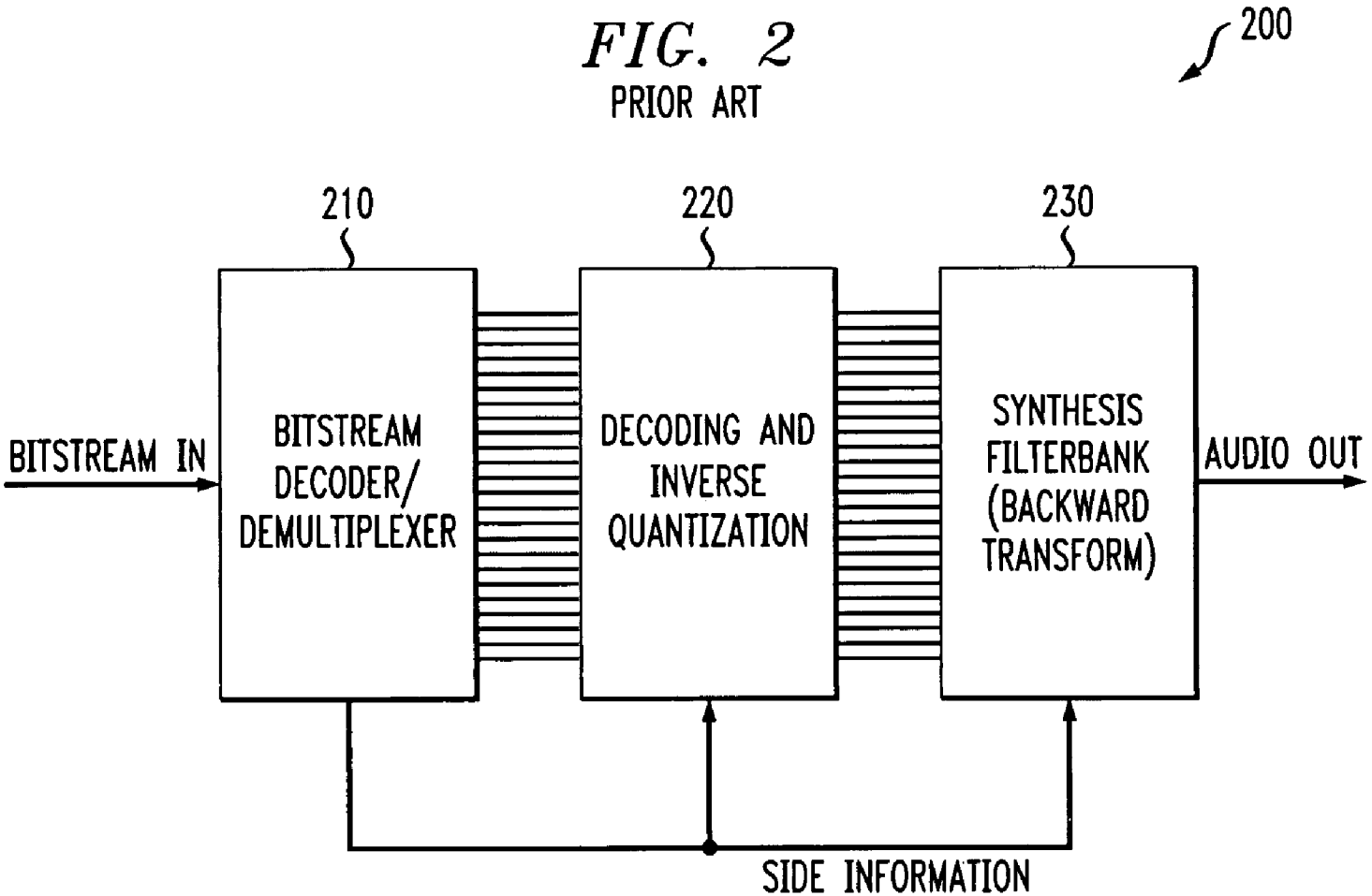
FIG. 2 PRIOR ART
FIG. 2 is a schematic block diagram of a conventional perceptual audio decoder corresponding to the perceptual audio coder of FIG. 1.

Well-known coding techniques, such as adaptive Huffman coding, may be employed by the quantizer/coder stage 320. If a transform coding scheme is applied to the pre-filtered signal by the quantizer/coder 320, the spectral and temporal resolution can be fully optimized for achieving a maximum coding gain under a mean square error (MSE) criteria. As discussed below, the perceptual noise shaping is performed by the post-filter 380. Assuming the distortions introduced by the quantization are additive white noise, the temporal and spectral structure of the noise at the output of the decoder 350 is fully determined by the characteristics of the post-filter 380. It is noted that the quantizer/coder stage 320 can include a filterbank such as the analysis filterbank 110 shown in FIG. 1. Likewise, the decoder/dequantizer stage 360 can include a filterbank such as the synthesis filterbank 230 shown in FIG. 2.

Pre-Filter/Post-Filter Based on Psychoacoustic Model

One implementation of the pre-filter 310 and post-filter 380 is discussed further below in a section entitled "Structure of the Pre-Filter and Post-Filter." As discussed below, it is advantageous if the structure of the pre-filter 310 and post-filter 380 also supports the appropriate frequency dependent temporal and spectral resolution. Therefore, a filter structure based on a frequency-warping technique is used which allows filter design on a non-linear frequency scale.

For using the frequency warping technique, the masked threshold needs to be transformed to an appropriate non-linear (i.e. warped) frequency scale as follows. Generally, the resulting procedure to obtain the filter coefficients g is:

Application of the psychoacoustic model gives a masked threshold as power (density) over frequency.

A non-linear transformation of the frequency scale according to the frequency warping, as discussed below, gives a transformed masked threshold.

Figure 6:
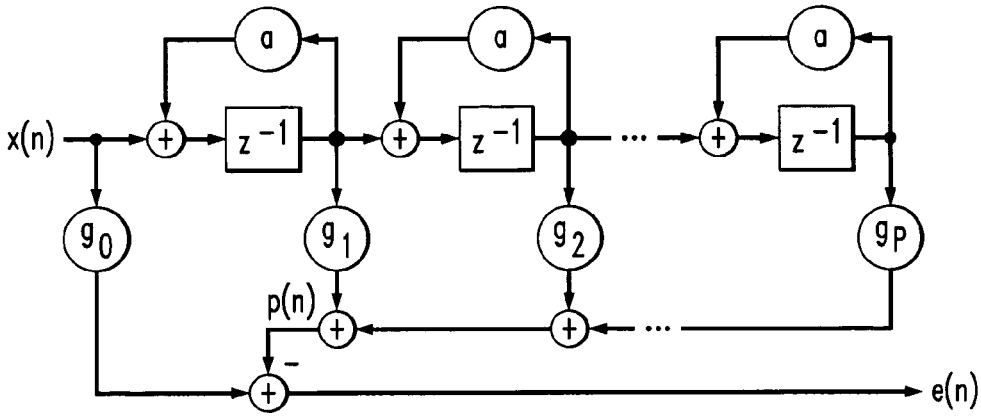
FIG. 6 PRIOR ART
FIG. 6 is a schematic diagram of an FIR filter and a corresponding IIR filter exhibiting frequency warping in accordance with one embodiment of the present invention.
Figure 6:
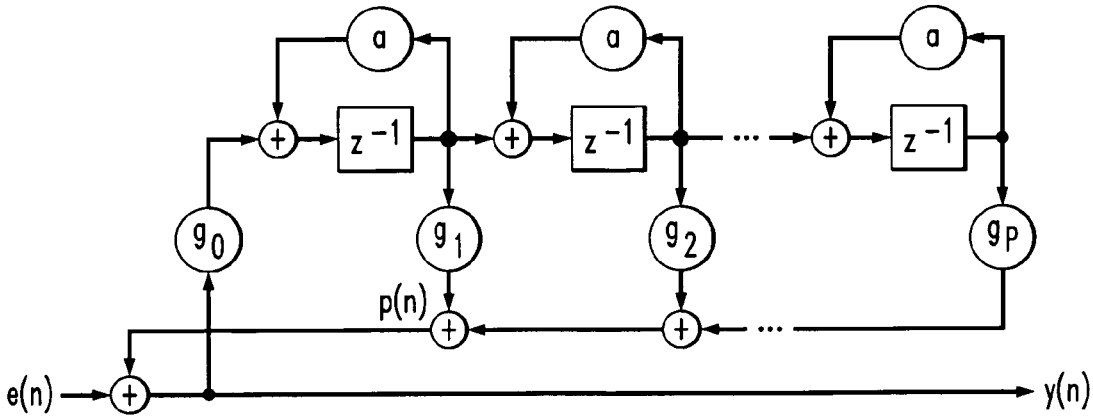
FIG. 6 PRIOR ART

Application of LPC analysis/modeling techniques leads to LPC filter coefficients h, which can be quantized and coded using a transformation to lattice coefficients or LSPs for use in the warped filter structure shown in FIG. 6, the LPC filter coefficients, h, need to be converted to filter coefficients, g.

The characteristics of the filter 310 may be adapted to the masked thresholds (as generated by the psychoacoustic model 315), using techniques known from speech coding, where linear-predictive coefficient (LPC) filter parameters are used to model the spectral envelope of the speech signal. In conventional speech coding techniques, the LPC filter parameters are usually generated in a way that the spectral envelope of the analysis filter output signal is maximally flat. In other words, the magnitude response of the LPC analysis filter is an approximation of the inverse of the input spectral envelope. The original envelope of the input spectrum is reconstructed in the decoder by the LPC synthesis filter. Therefore, its magnitude response has to be an approximation of the input spectral envelope. For a more detailed discussion of such conventional speech coding techniques, see, for example, W. B. Kleijn and K. K. Paliwal, "An Introduction to Speech Coding," in Speech Coding and Synthesis, Amsterdam: Elsevier (1995), incorporated by reference herein.

Similarly, the magnitude responses of the psychoacoustic post-filter 380 and pre-filter 310 should correspond to the masked threshold and its inverse, respectively. Due to this similarity, known LPC analysis techniques can be applied, as modified herein. Specifically, the known LPC analysis techniques are modified such that the masked thresholds are used instead of short-term spectra. In addition, for the pre-filter 310 and the post-filter 380, not only the shape of the spectral envelope has to be addressed, but the average level has to be included in the model as well. This can be achieved by a gain factor in the post-filter 380 that represents the average masked threshold level, and its inverse in the pre-filter 310.

Likewise, the filter coefficients may be efficiently transmitted using well-established techniques from speech coding, such as an LSP (line spectral pairs) representation, temporal interpolation, or vector quantization. For a detailed discussion of such speech coding techniques, see, for example, F. K. Soong and B.-H. Juang, "Line Spectrum Pair (LSP) and Speech Data Compression," in Proc. ICASSP (1984), incorporated by reference herein.

One important advantage of the pre-filter concept of the present invention over standard transform audio coding techniques is the greater flexibility in the temporal and spectral adaptation to the shape of the masked threshold. Therefore, the properties of the human auditory system should be taken into account in the selection of the filter structures. For a more detailed discussion of the characteristics of the masking effects, see, for example, M. R. Schroeder et al., "Optimizing Digital Speech Coders By Exploiting Masking Properties Of The Human Ear," Journal of the Acoust. Soc. Am., v. 66, 1647–1652 (December 1979); and J. H. Hall, "Auditory Psychophysics For Coding Applications," The Digital Signal Processing Handbook (V. Madisetti and D. B. Williams, eds.), 39-1:39-22, CRC Press, IEEE Press (1998), each incorporated by reference herein.

Generally, the temporal behavior is characterized by a relatively short rise time even starting before the onset of a masking tone (masker) and a longer decay after it is switched off. The actual extent of the masking effect also depends on the masker frequency leading to an increase of the temporal resolution with increasing frequency.

For stationary single tone maskers, the spectral shape of the masked threshold is spread around the masker frequency with a larger extent towards higher frequencies than towards lower frequencies. Both of these slopes strongly depend on the masker frequency leading to a decrease of the frequency resolution with increasing masker frequency. However, on the non-linear "Bark scale," the shapes of the masked thresholds are almost frequency independent. This Bark scale covers the frequency range from zero (0) to 20 kHz with 24 units (Bark).

While these characteristics have to be approximated by the psychoacoustic model 315, it is advantageous if the structure of the pre-filter 310 and post-filter 380 also supports the appropriate frequency dependent temporal and spectral resolution. Therefore, as previously indicated, the selected filter structure described below is based on a frequency-warping technique that allows filter design on a non-linear frequency scale.

Structure of the Pre-Filter and Post-Filter

Figure 4:
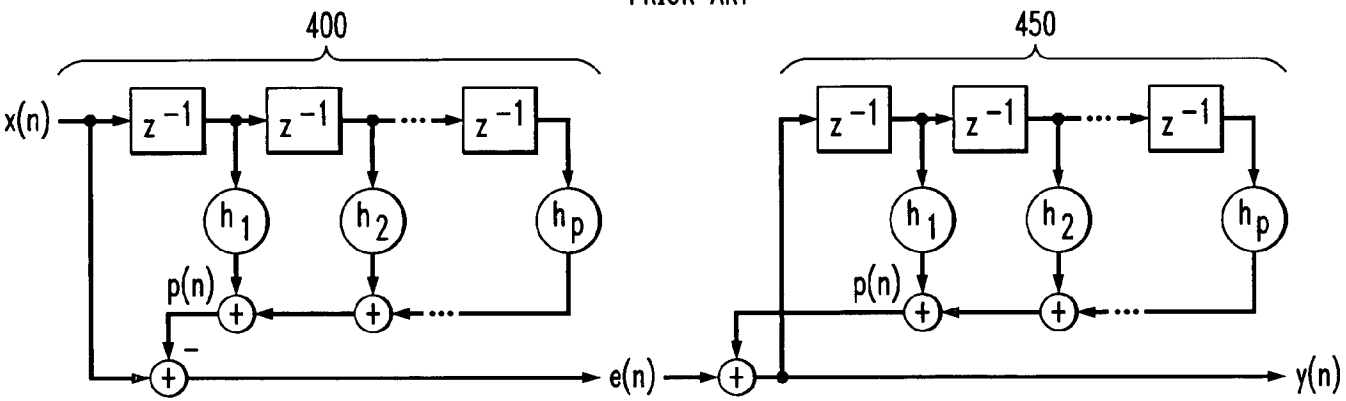
FIG. 4 PRIOR ART
FIG. 4. illustrates an FIR predictor of order P, and the corresponding IIR predictor.

The pre-filter 310 and post-filter 380 must model the shape of the masked threshold in the decoder 350 and its inverse in the encoder 300. The most common forms of predictors use a minimum phase finite-impulse response (FIR) filter in the encoder 300 leading to an IIR filter in the decoder. FIG. 4. illustrates an FIR predictor 400 of order P, and the corresponding IIR predictor 450. The structure shown in FIG. 4 can be made time-varying quite easily, since the actual coefficients in both filters are equal and therefore can be modified synchronously.

For modeling masked thresholds, a representation with the capability to give more detail at lower frequencies is desirable. For achieving such an unequal resolution over frequency, a frequency-warping technique, described, for example, in H. W. Strube, "Linear Prediction on a Warped Frequency Scale," J. of the Acoust. Soc. Am., vol. 68, 1071–1076 (1980), incorporated by reference herein, can be applied effectively. This technique is very efficient in the sense of achievable approximation accuracy for a given filter order which is closely related to the required amount of side information for adaptation.

Generally, the frequency-warping technique is based on a principle which is known in filter design from techniques like lowpass—lowpass transform and lowpass-bandpass transform. In a discrete time system an equivalent transformation can be implemented by replacing every delay unit by an all-pass. A frequency scale reflecting the non-linearity of the "critical band" scale would be the most appropriate. See, M. R. Schroeder et al., "Optimizing Digital Speech Coders By Exploiting Masking Properties Of The Human Ear," Journal of the Acoust. Soc. Am., v. 66, 1647–1652 (December 1979); and U. K. Laine et al., "Warped Linear Prediction (WLP) in Speech and Audio Processing," in IEEE Int. Conf. Acoustics, Speech, Signal Processing, III-349–III-352 (1994), each incorporated by reference herein.

Figure 5:
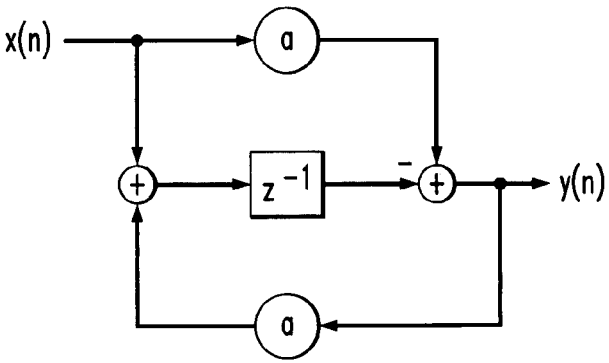
FIG. 5 PRIOR ART
FIG. 5 illustrates a first order allpass filter.

Generally, the use of a first order allpass filter 500, shown in FIG. 5, gives a sufficient approximation accuracy. However, the direct substitution of the first order allpass filter 500 into the FIR 400 of FIG. 4 is only possible for the pre-filter 310. Since the first order allpass filter 500 has a direct path without delay from its input to the output, the substitution of the first order allpass filter 500 into the feedback structure of the IIR 450 in FIG. 4 would result in a zero-lag loop. Therefore, a modification of the filter structure is required. In order to allow synchronous adaptation of the filter coefficients in the encoder and decoder, both systems should be modified as described hereinafter.

In order to overcome this zero-lag problem, the delay units of the original structure (FIG. 4) are replaced by first order IIR filters containing only the feedback part of the first order allpass filter 500, as described in H. W. Strube, incorporated by reference above. FIG. 6 is a schematic diagram of an FIR filter 600 and an IIR filter 650 exhibiting frequency warping in accordance with one embodiment of the present invention. The coefficients of the filter 600 need to be modified to obtain the same frequency as a structure with allpass units. The coefficients, $g_k(0 \leqq k \leqq P)$, are obtained from the original LPC filter coefficients with the following transformation:

$$g_k = \sum_{n=k}^{P} C_{kn} h_n \text{ with } C_{kn} = \binom{n}{k}(1-a^2)^k(-a)^{n-k}$$

The use of a first order allpass in the FIR filter 600 leads to the following mapping of the frequency scale:

$$\overline{\omega} = \omega + \arctan\frac{a\sin\omega}{1 - a\cos\omega}$$

The derivative of this function:

$$v(\omega) = \frac{\partial\overline{\omega}}{\partial\omega} = \frac{1-a^2}{1+a^2-2a\cos\omega}$$

indicates whether the frequency response of the resulting filter 600 appears compressed (v>1) or stretched (v<1). The warping coefficient $\alpha$ should be selected depending on the sampling frequency. For example, at 32 kHz, a warping coefficient value around 0.5 is a good choice for the pre-filter application.

It is noted that the pre-filter method of the present invention is also useful for audio file storage applications. In an audio file storage application, the output signal of the pre-filter 310 can be directly quantized using a fixed quantizer and the resulting integer values can be encoded using lossless coding techniques. These can consist of standard file compression techniques or techniques highly optimized for lossless coding of audio signals. This approach opens the applicability of techniques that, up to now, were only suitable for lossless compression towards perceptual audio coding.

It is to be understood that the embodiments and variations shown and described herein are merely illustrative of the principles of this invention and that various modifications may be implemented by those skilled in the art without departing from the scope and spirit of the invention.

The invention claimed is:

1. A method for encoding a signal, comprising the steps of:

filtering said signal using an adaptive filter having a plurality of subbands controlled by a psychoacoustic model, said adaptive filter producing a filter output signal and having a magnitude response that approximates an inverse of the masking threshold; and quantizing and encoding the filter output signal together with side information for filter adaptation control, wherein spectral and temporal resolutions of one or more subbands utilized in said encoding are selected independent of said adaptive filter.

2. The method of claim 1, wherein said quantizing and encoding step uses a transform or analysis filter bank suitable for redundancy reduction.

3. The method of claim 1, further comprising the steps of quantizing and encoding spectral components obtained from a transform or analysis filter bank, and wherein said quantizing and encoding steps employ fixed quantizer step sizes.

4. The method of claim 1, wherein said quantizing and encoding step reduces the mean square error in said signal.

5. The method of claim 1, wherein a filter order and intervals of filter adaptation of said adaptive filter are selected suitable for irrelevancy reduction.

6. The method of claim 1, wherein said signal is an audio signal.

7. The method of claim 1, wherein said signal is an image signal and said adaptive filter is controlled in a way that said magnitude response approximates an inverse of a visibility threshold.

8. The method of claim 1, further comprising the step of transmitting said encoded signal to a decoder.

9. The method of claim 1, further comprising the step of recording said encoded signal on a storage medium.

10. The method of claim 1, wherein said encoding further comprises the step of employing an adaptive Huffman coding technique.

11. The method of claim 1, wherein said filtering step is based on a frequency-warping technique using a non-linear frequency scale.

12. The method of claim 1, wherein the encoding stage for filter coefficients comprises a conversion from linear-predictive coefficient filter coefficients to lattice coefficients or to Line Spectrum Pairs.

13. A method for encoding a signal, comprising the steps of:

filtering said signal using an adaptive filter having a plurality of subbands controlled by a psychoacoustic model, said adaptive filter producing a filter output signal and having a magnitude response that approximates an inverse of the masking threshold; and transforming the filter output signal using a plurality of subbands suitable for redundancy reduction; and quantizing and encoding the subband signals together with side information for filter adaptation control, wherein spectral and temporal resolutions of one or more subbands utilized in said encoding are selected independent of said adaptive filter.

14. The method of claim 13, wherein said quantizing and encoding step uses a transform or analysis filter bank suitable for redundancy reduction.

15. The method of claim 13, further comprising the steps of quantizing and encoding spectral components obtained from a transform or analysis filter bank, and wherein said quantizing and encoding steps employ fixed quantizer step sizes.

16. The method of claim 13, wherein said quantizing and encoding step reduces the mean square error in said signal.

17. The method of claim 13, wherein a filter order and intervals of filter adaptation of said adaptive filter are selected suitable for irrelevancy reduction.

18. The method of claim 13, wherein said filtering step is based on a frequency-warping technique using a non-linear frequency scale.

19. The method of claim 13, wherein the encoding stage for filter coefficients comprises a conversion from linear-predictive coefficient filter coefficients to lattice coefficients or to Line Spectrum Pairs.

20. A method for decoding a signal, comprising the steps of:

decoding and dequantizing said signal;

decoding side information for filter adaptation control transmitted with said signal; and filtering the dequantized signal with an adaptive filter having a plurality of subbands controlled by said decoded side information, said adaptive filter producing a filter output signal and having a magnitude response that approximates the masking threshold, wherein spectral and temporal resolutions of one or more subbands utilized in said decoding are selected independent of said adaptive filter.

21. The method of claim 20, wherein said decoding and dequantizing step uses an inverse transform or synthesis filter bank suitable for redundancy reduction.

22. The method of claim 20, further comprising the steps of decoding and dequantizing spectral components obtained from a transform or synthesis filter bank, and wherein said decoding and dequantizing steps employ fixed quantizer step sizes.

23. The method of claim 20, wherein a filter order and intervals of filter adaptation of said adaptive filter are selected suitable for irrelevancy reduction.

24. The method of claim 20, wherein the decoding stage for filter coefficients comprises a conversion from lattice coefficients or to Line Spectrum Pairs to linear-predictive coefficient filter coefficients.

25. A method for decoding a signal transmitted using a plurality of subband signals, comprising the steps of:

decoding and dequantizing said transmitted subband signals;

decoding side information for filter adaptation control transmitted with said signal;

transforming said subbands to a filter input signal; and filtering the filter input signal with an adaptive filter having a plurality of subbands controlled by said decoded side information, said adaptive filter producing a filter output signal and having a magnitude response that approximates the masking threshold, wherein spectral and temporal resolutions of one or more subbands utilized in said decoding are selected independent of said adaptive filter.

26. The method of claim 25, wherein said decoding and dequantizing step uses an inverse transform or synthesis filter bank suitable for redundancy reduction.

27. The method of claim 25, further comprising the steps of decoding and dequantizing spectral components obtained from a transform or synthesis filter bank, and wherein said decoding and dequantizing steps employ fixed quantizer step sizes.

28. The method of claim 25, wherein a filter order and intervals of filter adaptation of said adaptive filter are selected suitable for irrelevancy reduction.

29. The method of claim 25, wherein the decoding stage for filter coefficients comprises a conversion from lattice coefficients or to Line Spectrum Pairs to linear-predictive coefficient filter coefficients.

30. An encoder for encoding a signal, comprising:

an adaptive filter controlled by a psychoacoustic model, said adaptive filter having a plurality of subbands producing a filter output signal and having a magnitude response that approximates an inverse of the masking threshold; and a quantizer/encoder for quantizing and encoding the filter output signal together with side information for filter adaptation control, wherein spectral and temporal resolutions of one or more subbands utilized in said encoder are selected independent of said adaptive filter.

31. An encoder for encoding a signal, comprising:

an adaptive filter controlled by a psychoacoustic model, said adaptive filter having a plurality of subbands producing a filter output signal and having a magnitude response that approximates an inverse of the masked masking threshold; and a plurality of subbands suitable for redundancy reduction for transforming the filter output signal; and a quantizer/encoder for quantizing and encoding the subband signals together with side information for filter adaptation control, wherein spectral and temporal resolutions of one or more subbands utilized in said encoder are selected independent of said adaptive filter.

32. A decoder for decoding a signal, comprising:

a decoder/dequantizer for decoding and dequantizing said signal and decoding side information for filter adaptation control transmitted with said signal; and an adaptive filter having a plurality of subbands controlled by said decoded side information, said adaptive filter producing a filter output signal and having a magnitude response that approximates the masking threshold, wherein spectral and temporal resolutions of one or more subbands utilized in said decoder are selected independent of said adaptive filter.

33. A decoder for decoding a signal transmitted using a plurality of subband signals, comprising:

a decoder/dequantizer for decoding and dequantizing said transmitted subband signals and decoding side information for filter adaptation control transmitted with said signal;

means for transforming said subbands to a filter input signal; and an adaptive filter having a plurality of subbands controlled by said decoded side information, said adaptive filter producing a filter output signal and having a magnitude response that approximates the masking threshold, wherein spectral and temporal resolutions of one or more subbands utilized in said decoder are selected independent of said adaptive filter.

* * * * *

UNITED STATES PATENT AND TRADEMARK OFFICE

CERTIFICATE OF CORRECTION

PATENT NO. : 7,110,953 B1
APPLICATION NO. : 09/586072
DATED : September 19, 2006
INVENTOR(S) : Edler et al.

It is certified that error appears in the above-identified patent and that said Letters Patent is hereby corrected as shown below:

On Title Page, item 56 in the section entitled "Other Publications" include the following two references:

-- Huang et al., "Statistical Prediction for Low-Bit Rate/High Quality Sound Coding," Seminars Statistics and Data Mining Research; Bell Laboratories, http://cm.bell-labs.com/cm/ms/departments/sia/seminars/abs_seminars html#tue_d_Yu, Downloaded on February 24, 2003. --

-- Painter; T , "Perceptual Coding of Digital Audio," Proceedings of the IEEE, vol. 88, no. 4, pgs. 451-515 (April 2000) --

In the item 57 "Abstract" please delete the final two sentences that begin "Ihe characteristics of the pre-filter may be adapted to the masked thresholds....." and "Likewise, the filter coefficients may be efficiently transmitted....." respectively.

Column 3, line 61, replace "FIR" with -- Finite Impulse Response (FIR). --.

Column 3, line 62, replace "IIR" with -- Infinite Impulse Response (IIR) --.

Column 5, line 6, before "analysis/modeling" and after "of" replace "LPC" with -- linear-predictive coefficient (LPC) --.

Column 5, line 9, replace "LSPs" with -- line spectral pairs (LSPs) --.

Column 5, line 47, before "representation" and after "LSP" delete -- (line spectral pairs) --.

UNITED STATES PATENT AND TRADEMARK OFFICE

CERTIFICATE OF CORRECTION

PATENT NO. : 7,110,953 B1
APPLICATION NO. : 09/586072
DATED : September 19, 2006
INVENTOR(S) : Edler et al.

It is certified that error appears in the above-identified patent and that said Letters Patent is hereby corrected as shown below:

Column 6, line 32, before "filter" and after "to an" replace "IIR" with -- infinite impulse Response --.

Signed and Sealed this

Seventeenth Day of July, 2007

JON W. DUDAS
*Director of the United States Patent and Trademark Office*